US010003152B1

(12) United States Patent
Bianca et al.

(10) Patent No.: US 10,003,152 B1
(45) Date of Patent: Jun. 19, 2018

(54) REVERSE-GENDER PIN CONTACT FOR USE WITH A CONNECTOR HAVING A HIGH DENSITY LAYOUT

(71) Applicant: TE CONNECTIVITY CORPORATION, Berwyn, PA (US)

(72) Inventors: Giuseppe Bianca, Playa Vista, CA (US); Alex Robert Rengifo, Oceanside, CA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days. days.

(21) Appl. No.: 15/414,734

(22) Filed: Jan. 25, 2017

(51) Int. Cl.
*H01R 13/432* (2006.01)
*H01R 43/20* (2006.01)
*H01R 43/16* (2006.01)

(52) U.S. Cl.
CPC ..... *H01R 13/432* (2013.01); *H01R 43/16* (2013.01); *H01R 43/20* (2013.01)

(58) Field of Classification Search
CPC ..... H01R 13/434; H01R 13/41; H01R 13/432
USPC ..... 439/733.1, 744, 750, 825
See application file for complete search history.

(56) References Cited

U.S. PATENT DOCUMENTS

| | | | | | |
|---|---|---|---|---|---|
| 3,124,407 | A * | 3/1964 | Lazar et al. | H01R 13/434 | 439/732 |
| 4,278,313 | A * | 7/1981 | Blakesley | H01R 13/28 | 439/290 |
| 7,462,079 | B2 * | 12/2008 | Fabian | H01R 4/4818 | 439/438 |
| 7,931,507 | B2 * | 4/2011 | Yu | H01R 13/426 | 439/607.01 |
| 7,942,697 | B2 * | 5/2011 | Bloomfield | H01R 13/434 | 439/595 |
| 8,251,758 | B2 * | 8/2012 | Yoshida | H01R 13/112 | 439/290 |
| 8,371,871 | B1 * | 2/2013 | Murphy | H01R 12/585 | 439/444 |
| 2010/0273363 | A1 * | 10/2010 | Orris | H01R 13/432 | 439/745 |
| 2011/0021089 | A1 * | 1/2011 | Yoshida | H01R 13/112 | 439/733.1 |
| 2011/0059659 | A1 * | 3/2011 | Matsumoto | H01R 13/426 | 439/733.1 |
| 2013/0244503 | A1 * | 9/2013 | Yamaguchi | H01R 13/432 | 439/733.1 |

* cited by examiner

*Primary Examiner* — Tulsidas C Patel
*Assistant Examiner* — Marcus Harcum

(57) ABSTRACT

A reverse-gender pin contact for use with a connector having a high density layout, includes a body having a hollow first portion extending along an axis for receiving a conductor. The first portion extends along the axis to a neck, the neck extending along the axis to an engaging end for insertion inside a mating socket contact. A retention feature extends from the neck transverse to the axis.

5 Claims, 5 Drawing Sheets

REVERSE-GENDER PIN CONTACT FOR USE WITH A CONNECTOR HAVING A HIGH DENSITY LAYOUT

FIELD OF THE INVENTION

The present invention is directed to connectors having high density layouts. In particular, the invention is directed to reverse-gender connectors having high density layouts.

BACKGROUND OF THE INVENTION

Electrical connectors provide communicative interfaces between electrical components where power and/or signals may be transmitted therethrough. For example, the electrical connectors may be used within telecommunication equipment, servers, and data storage or transport devices. Typically, electrical connectors are used in environments, such as in offices or homes, where the connectors are not subjected to constant shock, vibration, and/or extreme temperatures. However, in some applications, such as aerospace or military equipment, the electrical connector must be configured to withstand certain conditions and still effectively transmit power and/or data signals.

In some connector arrangements, the mating contacts have a reverse gender construction. For example, in one connector each pin contact is secured in a cylindrical insulator or insert. In the mating connector, each hollow tubular socket is constructed such that when the connectors are brought together or engaged, each tubular socket is inserted into a corresponding insert, with each tubular socket simultaneously receiving a corresponding pin to establish an electrical connection therebetween. Moreover, it is often desirable to reduce the size of the connectors. In such connector arrangements, sometimes referred to as having a "high density layout", the center-to-center distance between adjacent pins may be so small that there is no room for conventional contact retention features (i.e., molded retention fingers or a retention clip). As a result, these connectors typically require encapsulation of contacts and are configured such that it is not possible to replace a "bad" contact pin. That is, if a pin contact becomes inoperable, the entire connector must be replaced, which is costly, time-consuming and wasteful.

Accordingly, there is a need for improved connectors employing reverse-gender contacts that do not suffer from these drawbacks.

SUMMARY OF THE INVENTION

An embodiment is directed to a reverse-gender pin contact for use with a connector having a high density layout, including a body having a hollow first portion extending along an axis for receiving a conductor. The first portion extends along the axis to a neck, the neck extending along the axis to an engaging end for insertion inside a mating socket contact. A retention feature extends from the neck transverse to the axis.

A further embodiment is directed to a reverse-gender pin contact for use with a connector having a high density layout, including a body formed from a single foil layer. The body has a hollow first portion extending along an axis for receiving a conductor, the first portion extending along the axis to a neck, the neck extending along the axis to an engaging end for insertion inside a mating socket contact. A retention feature extends from the neck transverse to the axis.

A yet further embodiment is directed to a method for retaining a reverse-gender pin contact in a connector having a high density layout, including providing a body having a hollow first portion extending along a first axis for receiving a conductor, the first portion extending along the first axis to a neck, the neck extending along the first axis to an engaging end for insertion inside a mating socket contact, the neck including a retention feature extending from the neck transverse to the first axis, the neck and the retention feature having a first cross-sectional area transverse to the first axis. The method further includes providing the connector having a hollow insulator for receiving the body therein, the insulator having a first end, a second end and a second axis, the insulator having a shoulder positioned between the first end and the second end, a portion of the insulator between the first end and shoulder defining a first section, a portion of the insulator between the second end and shoulder defining a second section, the shoulder having a second cross-sectional area transverse to the second axis, the second cross-sectional area being greater than the first cross-sectional area. The method further includes directing an end of the conductor inside the first portion, and securing the end of the conductor and the first portion together. The method further includes directing the engaging end along the second axis inside the first section until the retention feature is brought into contact with the shoulder. The method includes further directing the engaging end along the second axis toward the second section, at least the retention feature being subjected to compressive forces by the shoulder, resulting in a reduction of the first cross-sectional area of the retention feature and neck, permitting the retention feature and neck to slide inside of and past the shoulder, whereupon the retention feature returning to an uncompressed condition upon entering the second section, thereby retaining the engaging end inside the second section.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

The description of illustrative embodiments according to principles of the present invention is intended to be read in connection with the accompanying drawings, which are to be considered part of the entire written description. Terms such as "attached," "affixed," "connected," "coupled," "interconnected," "engaged," "installed" and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

Figure 1:
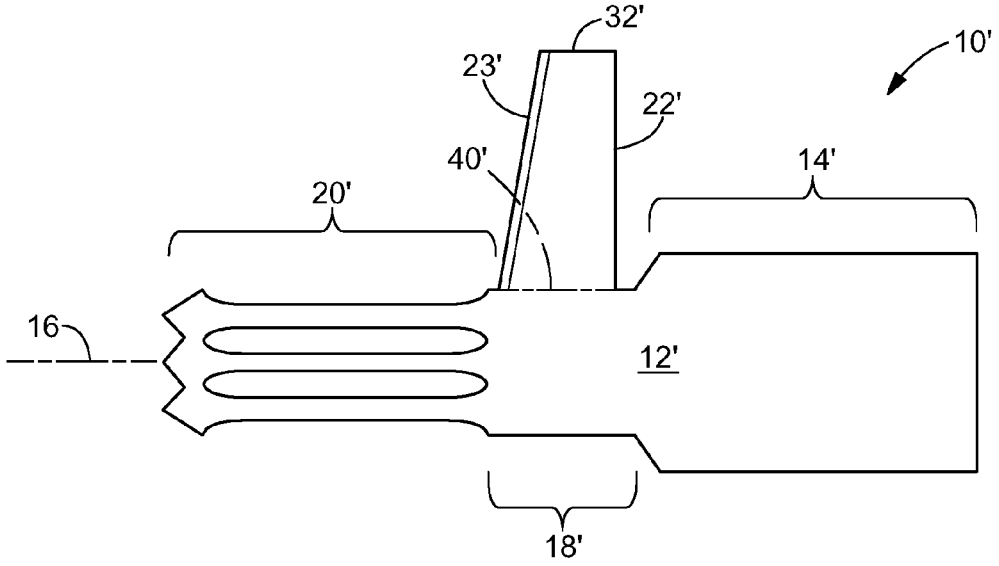
FIG. 1 is a flat pattern of an exemplary pin contact of the present invention.
Figure 3:
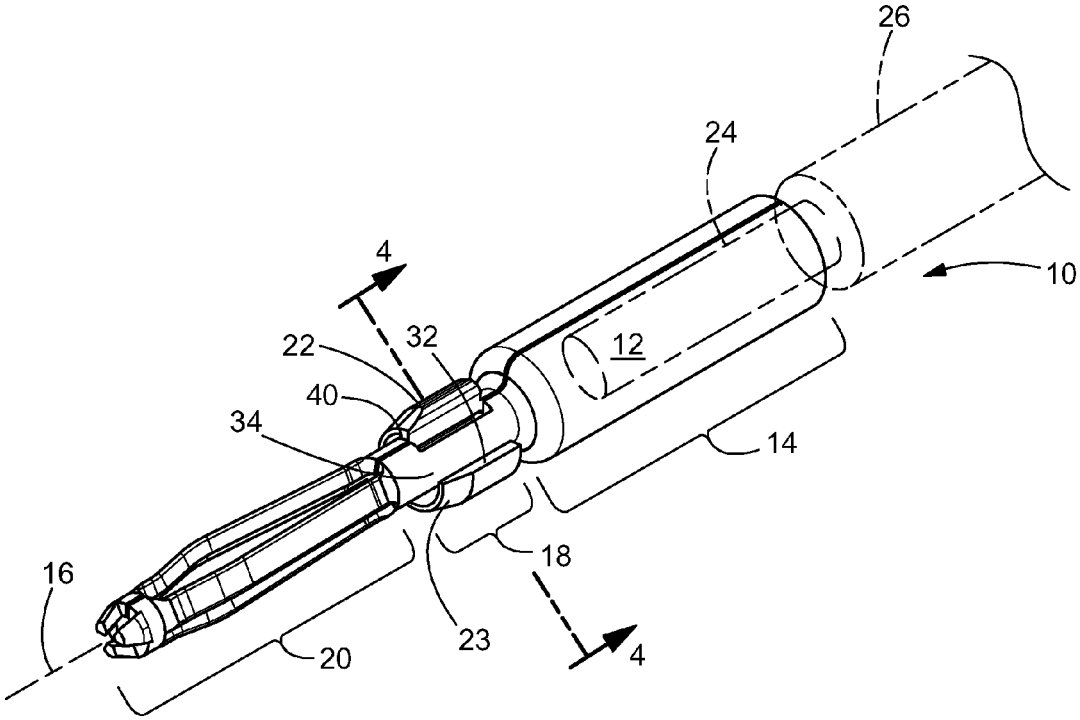
FIG. 3 is an upper perspective view of a formed pin contact of FIG. 1 of the present invention.

FIG. 1 is a flat pattern of an exemplary pin contact 10' that is formed from a single foil layer, which when formed (i.e., rolled), becomes a formed pin contact 10 (FIG. 3). Pin contact 10' includes a body 12' having a portion 14' that extends along an axis 16 to a neck 18'. Neck 18' extends along axis 16 to an engaging end 20'. A retention feature 22' extends from neck 18' to an opposed end 32' in a direction transverse to axis 16. The base of retention feature 22' has a fold line 40' that is parallel to axis 16. The side of retention feature 22' facing engaging end 20' has a chamfer 23'.

Figure 4:
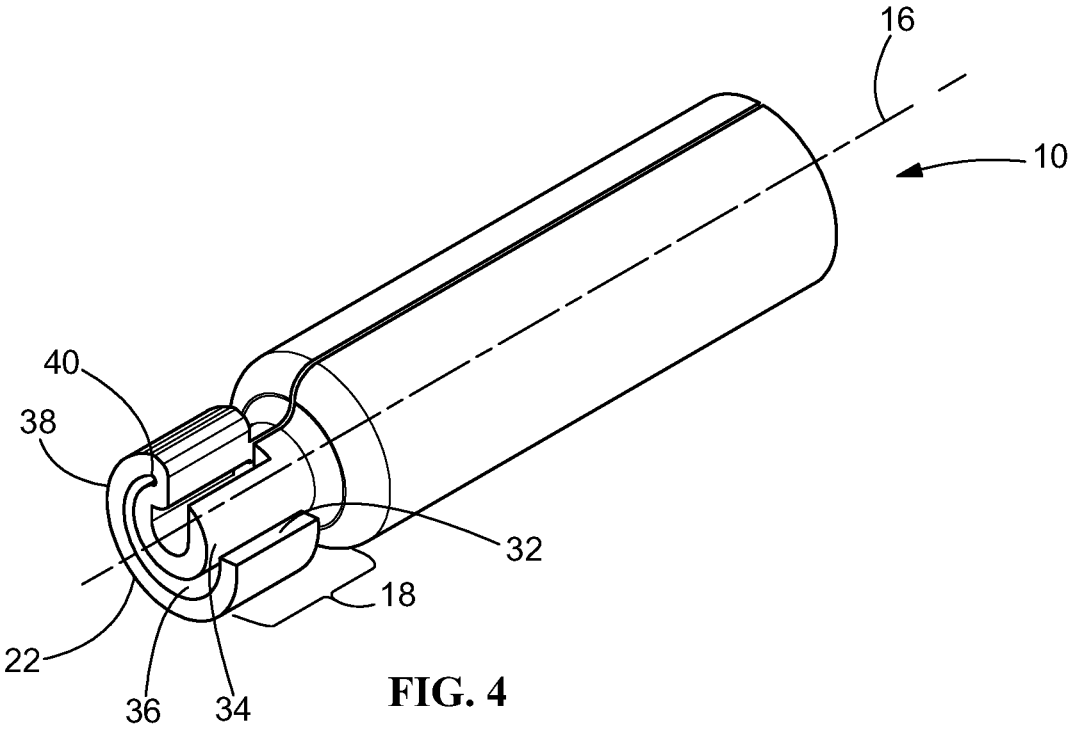
FIG. 4 is a partial cutaway view of formed pin contact of FIG. 1 of the present invention.

Components of flat pattern pin contact 10' of FIG. 1 correspond to formed pin contact 10 of FIG. 3. That is, pin contact 10 includes a body 12 having a hollow portion 14 that extends along an axis 16 to a neck 18. Portion 14 is adapted to receive an end of a conductor 24, and more specifically, an end of an exposed conductor 24 resulting from stripping an insulating layer from an end of an insulated wire 26, the conductor being directed inside of portion 14, after which portion 14 is crimped over conductor 24 to secure the portion and the conductor together, establishing mechanical and electrical connections therebetween. Neck 18 extends along axis 16 to an engaging end 20. A retention feature 22 extends from neck 18 to an opposed end 32 in a direction transverse to axis 16, which retention feature 22 is folded about a fold line 40 so as to extend at least partially along a periphery 34 of neck 18. Chamfer 23 formed in retention feature 22 faces engaging end 20, providing a region that is transverse to axis 16 having a reduced cross-sectional area as compared to cross-sectional area 38 (FIG. 4). In one embodiment, engaging end 20 corresponds to 24 gauge contact, although other gauge contact sizes may be employed.

For purposes of clarity, FIG. 4 is a partial cutaway view of the assembled pin contact 10 of FIG. 3 taken along line 4-4 of FIG. 3. That is, to obtain the partial cutaway view of FIG. 4, the portion of pin contact 10 of FIG. 3 which includes engaging end 20, as well as a segment of neck 18 and retention feature 22 that intersect along line 4-4 of FIG. 3, are removed. As further shown in FIG. 4, after retention feature 22 is folded along fold line 40 at least partially over the periphery 34 of neck 18, the surface of retention feature 22 facing the periphery of neck 18 and periphery 34 of neck are separated by a gap 36. Neck 18 and retention feature 22 have a cross-sectional area 38 that is transverse to axis 16.

Figure 2:
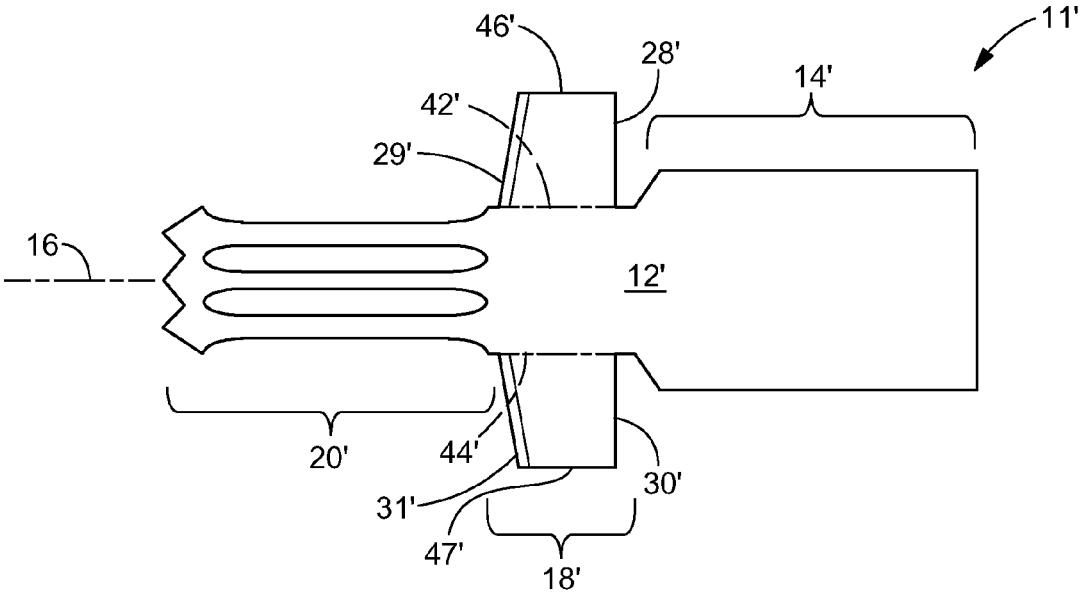
FIG. 2 is a flat pattern of an exemplary pin contact of the present invention.

FIG. 2 is a flat pattern of an exemplary pin contact 11' that is similar to pin contact 10' of FIG. 1, except as shown. More specifically, neck 18' includes retention feature portions or portions or retention features 28', 30' which extend to respective opposed ends 46', 47' and having respective fold lines 42', 44' extending parallel to axis 16. The side of retention features 28', 30' facing engaging end 20' have respective chamfers 29', 31'.

Figure 5:
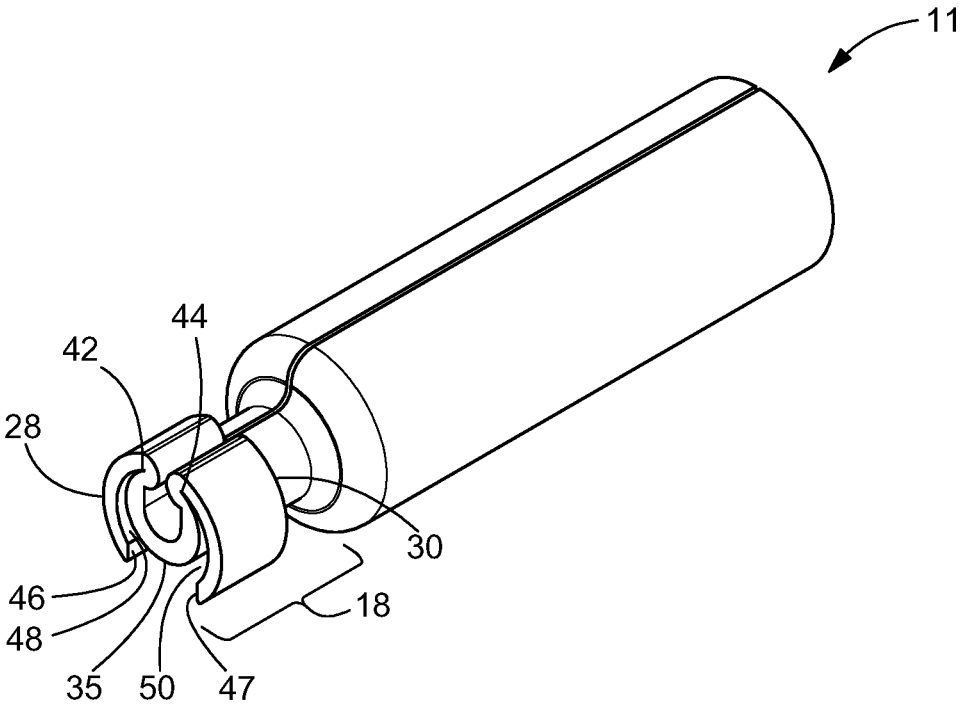
FIG. 5 is a partial cutaway view of the formed contact of FIG. 2 of the present invention.

For purposes of clarity, FIG. 5 is a partial cutaway view of the assembled pin contact 11 showing features in a similar fashion as assembled pin contact 10 of FIG. 4. As further shown in FIG. 5, after retention features 28, 30 are folded along respective fold lines 42, 44 at least partially over the periphery 35 of neck 18 in opposite directions. As a result of folding, the surface of retention feature 28 facing the periphery of neck 18 and periphery 34 of neck are separated by a gap 48. Similarly, as a result of folding, the surface of retention feature 30 facing the periphery of neck 18 and periphery 34 of neck are separated by a gap 50.

Figure 6:
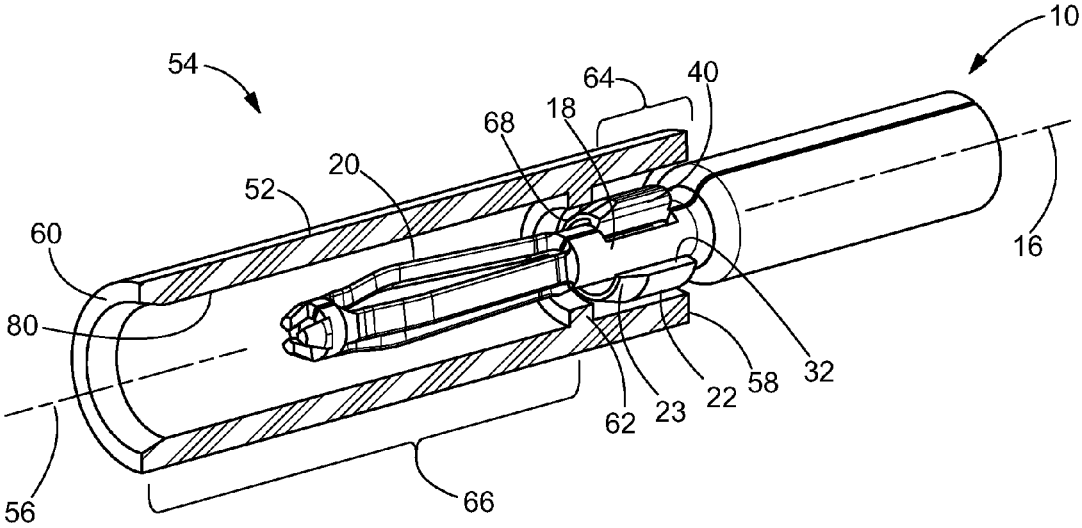
FIGS. 6-8 are partial cutaway views showing sequential insertion of an exemplary contact pin in an insert of a connector of the present invention.
Figure 7:
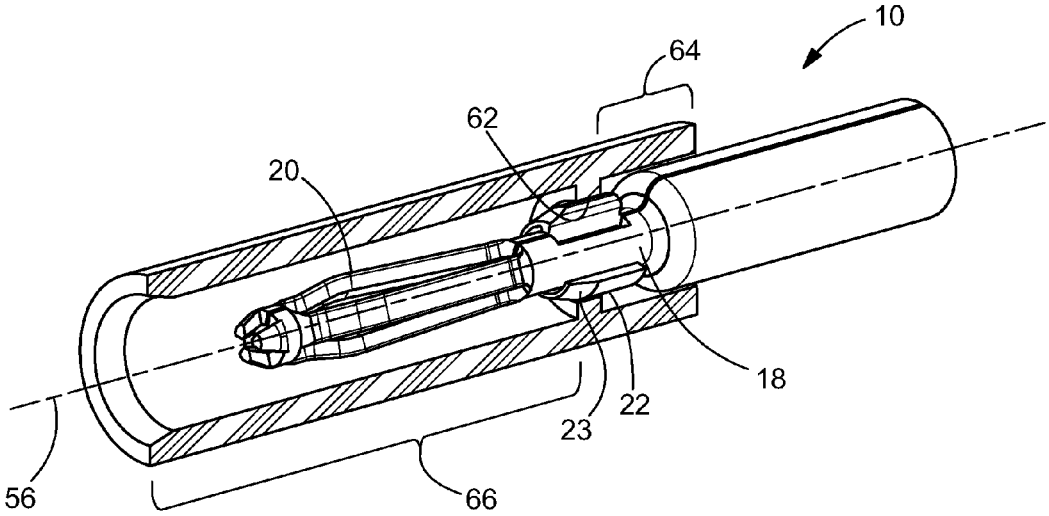
Figure 8:
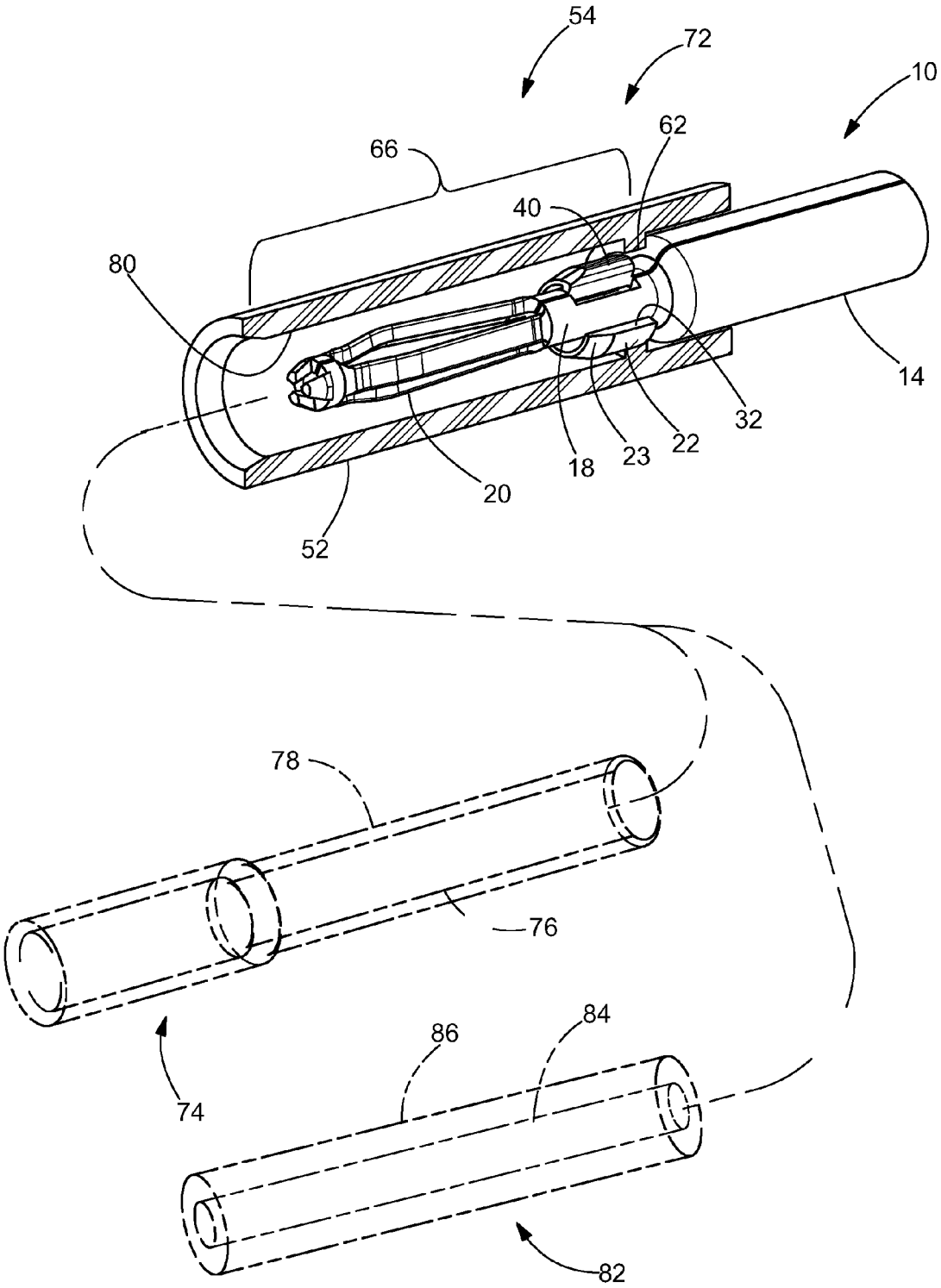

FIGS. 6-8 are partial cutaway views showing sequential insertion of an exemplary contact pin 10 inside a hollow insert or insulator 52 of a connector 54 having a high density layout. Insert or insulator 52 has an axis 56 and includes opposed ends 58, 60 having a shoulder stop or shoulder 62 positioned between ends 58, 60. Insulator 52 further includes a first section 64 positioned between shoulder 62 and end 58 and a second section 66 positioned between shoulder 62 and end 60. Shoulder 62 has a cross-sectional area 68 that is transverse to axis 56.

As further shown in FIG. 6, engaging end 20 of pin contact 10 is directed along axis 56 inside of first section 64 and then inside of second section 66 until chamfer 23 of retention feature 22 is brought into contact with shoulder 62. Although cross-sectional area 38 (FIG. 4) of neck 18 and retention feature 22 is greater than cross-sectional area 68 of shoulder 62, the cross-sectional area of chamfer 23 is less than cross-sectional area 68 such that chamfer 23 is partially inserted inside of shoulder 62. In response to application of force to pin contact 10 along axis 56 toward second section 66, chamfer 23 is further inserted inside of shoulder 62, resulting in compressive radial forces being applied by shoulder 62 to retention feature 22, resulting in a reduction of the cross-sectional area 38 of neck 18 (FIG. 4) and retention feature 22, or a reduction in gap 36 (FIG. 4), such that retention feature 22 is directed inside of shoulder 62, such as shown in FIG. 7.

As further shown in FIG. 8, in response to further application of force to pin contact 10 along axis 56 toward second section 66, retention feature 22 slides inside of and past shoulder 62, whereupon retention feature 22 enters second section 66. Portion 14 abuts shoulder 62 to limit further insertion of pin contact 10 inside of insert 52. Upon entering second section 66, the retention feature 22 is no longer subjected to the compressive radial forces applied by shoulder 62, permitting the cross-sectional area of retention feature 22 and neck 18 to return to an uncompressed condition (cross-sectional area 38 (FIG. 4)). In the uncompressed condition 38 (cross-sectional area 38 (FIG. 4)), retention feature 22 retains pin contact 10 in an installed position 72, i.e., prevents the pin contact from being withdrawn from second section 66.

Once inserted pin contact 10 is retained inside connector 54 in installed position 72 (FIG. 8), pin contact 10 can receive a mating socket contact 74 from a mating connector (not shown). That is, as socket contact 74 is directed inside of insert 52, an outer surface 78 of the socket contact is slidably received inside of an inner surface 80 of the insert, and simultaneously, engaging end 20 of pin contact 10 is slidably received inside of an inner surface 76 of the socket contact. The contact between engaging end 20 and inner surface 76 forms the electrical connection between pin contact 10 and socket contact 74.

The pin contact arrangement of the present invention provides several advantages. First, the amount of the installation force associated with directing pin contact 10 inside of insert 52 is sufficiently low such that insulated wire 26 (FIG. 3) may be manually directed or inserted inside of the insert to its installed position 72, and does not require an insert tool. Second, pin contact 10 can be removed from its installed position 72, such as with a removal tool 82 (FIG.

8) that is similarly configured as socket contact 74. That is, removal tool 82 has an outer surface 86 which is slidably received inside of inner surface 80 of insert 52, and simultaneously, engaging end 20 of pin contact 10 is slidably received inside of an inner surface 84 of the removal tool. However, the end of inner surface 84 of removal tool 82 is sized to slide over chamfer 23 and axially compress retention feature 22 to permit removal of pin contact 10 from insert 52 in a reverse manner from insertion of the pin contact as previously discussed.

It is to be understood the chamfers 29, 31 of pin contact 11 (shown as 29', 31' of pin contact 11' of FIG. 2) operate in a manner similar to that of chamfer 23 of pin contact 10 to effect such advantageous installation and removal.

The pin contact arrangement and connector utilizing the pin contact arrangement in a high density layout of the present invention may be configured for many applications, such as high-speed telecommunications equipment, various classes of servers, and data storage and transport devices. Also, the pin contact arrangement and connector may be configured to transmit high-speed: differential signals. As used herein, the term "high-speed" includes transmission speeds of approximately one (1) gigabit/s or greater. In one embodiment, the connector is configured to transmit approximately 10 gigabit/s or greater. Furthermore, the pin contact arrangement and connector may perform at high speeds and maintain signal integrity while withstanding vibrations and shock that may be experienced during, for example, aerospace or military operations. As such, the pin contact arrangement and connector may be configured to satisfy known industry standards including military specifications, such as MIL-DTL-83513. However, embodiments described herein are not limited to applications for extreme environments, but may also be used in other environments, such as in an office or home.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A reverse-gender pin contact for use with a connector having a high density layout, comprising:

a body having a hollow first portion extending along an axis for receiving a conductor, the first portion extending along the axis to a neck, the neck extending along the axis to an engaging end for insertion inside a mating socket contact; and a retention feature extending from the neck at least partially along a periphery of the neck and transverse to the axis along a fold line parallel to the axis, the retention feature overlapping and radially separated from the periphery by a gap;

wherein in response to a compressive radial force applied to the retention feature, the gap is reduced.

2. The reverse-gender pin contact of claim 1, wherein the retention feature has a second portion extending along a portion of the neck in a first direction, and a third portion extending along another portion of the neck in a second direction opposite the first direction.

3. The reverse-gender pin contact of claim 1, wherein the reverse-gender pin contact is formed from a single foil layer.

4. A reverse-gender pin contact for use with a connector having a high density layout, comprising:

a body formed from a single foil layer, the body having a hollow first portion extending along an axis for receiving a conductor, the first portion extending along the axis to a neck, the neck extending along the axis to an engaging end for insertion inside a mating socket contact; and a retention feature extending from the neck at least partially along a periphery of the neck and transverse to the axis along a fold line parallel to the axis, the retention feature overlapping and radially separated from the periphery by a gap;

wherein in response to a compressive radial force applied to the retention feature, the gap is reduced.

5. The reverse-gender pin contact of claim 4, wherein the retention feature has a second portion extending along a portion of the neck in a first direction, and a third portion extending along another portion of the neck in a second direction opposite the first direction.

* * * * *